United States Patent [19]

Corey

[11] Patent Number: 4,633,668

[45] Date of Patent: Jan. 6, 1987

[54] TWO PISTON V-TYPE STIRLING ENGINE

[75] Inventor: John A. Corey, North Troy, N.Y.

[73] Assignee: Mechanical Technology Incorporated, Latham, N.Y.

[21] Appl. No.: 605,470

[22] Filed: Apr. 30, 1984

[51] Int. Cl.[4] ..... F02G 1/04

[52] U.S. Cl. ..... 60/526; 60/517

[58] Field of Search ..... 60/517, 526

[56] References Cited

U.S. PATENT DOCUMENTS

| | | | |
|---|---|---|---|
| 3,688,512 | 9/1972 | Prast et al. | 60/517 X |
| 3,756,018 | 9/1973 | Hakansson | 60/522 |
| 3,812,677 | 5/1974 | Gries | 60/517 |
| 3,845,624 | 11/1974 | Roos | 60/517 |
| 3,999,388 | 12/1976 | Nystrom | 60/521 |
| 4,055,952 | 11/1977 | Johansson et al. | 60/517 |

*Primary Examiner*—Allen M. Ostrager

*Attorney, Agent, or Firm*—Joseph V. Claeys; Joseph C. Sullivan

[57] ABSTRACT

A two piston Stirling engine which includes a heat exchanger arrangement placing the cooler and regenerator directly adjacent the compression space for minimal cold duct volume; a sealing arrangement which eliminates the need for piston seals, crossheads and piston rods; and a simplified power control system.

3 Claims, 3 Drawing Figures

TWO PISTON V-TYPE STIRLING ENGINE

The Government of the United States of America has rights in this invention pursuant to Contract DEN3-32 awarded by the United States Department of Energy.

FIELD OF THE INVENTION

The present invention is directed towards providing a Stirling engine, particularly one which is a two piston V-type.

BACKGROUND OF THE INVENTION

With the renewed and ever expanding interest in Stirling engines, efforts have been made to continually improve upon their design. Basic Stirling engine principals of operations are set forth in a text entitled "Stirling Engines" by G. Walker, 1st Edition, 1980. Essentially in this regard, a Stirling engine operates on the principal of heating and cooling a working fluid (gas), with the expansion and compression of the gas utilized to perform useful work. A variety of designs are illustrated in the aforenoted text with their attendant advantages.

A typical Stirling cycle consists of a contained volume divided into the following adjacent regions: compression (or cold) space, cooler, regenerator, heater and expansion (or hot) space. In actual construction though these spaces are necessarily connected by ineffective regions or connecting ducts. Thermodynamically, it is less severe when occurring between the regions where working fluid is hot and less dense than when occurring in the cooler regions where the working fluid is more dense. In most cases, the largest connecting volumes are between heater and expansion space, and cooler and cold space. Of these two, the cold duct is the most disadvantageous to power density and efficiency, so it is, an object of this design to minimize that volume.

In addition, the majority of present Stirling engines utilize lighter-than-air gases such as hydrogen or helium as the working fluid due to their relatively high conductivity, high specific heat and low viscosity. However, a disadvantage of a lighter-than-air Stirling engine is that a fixed inventory of the gas is required and therefore also fairly completed sealing between the working spaces and ambient conditions. Current hydrogen and helium engines use a sliding seal on a rod between the pistons and the crossheads (which absorb side loads), to prevent oil leakage from the crankcase into the working space and working fluid leakage from working space to crankcase. Such an arrangement adds complexity, weight and volume to the engine.

Other designs envision the use of air as a working fluid. While such air-cycle engines avoid certain of the sealing requirements of the lighter-than-air engines and have other advantages to compensate for air's relatively poor fluid properties, a variety of design hurdles must be overcome, particularly providing an efficient power to weight ratio, since many of such air-cycle engines tend to be relatively heavy and need to be improved and simplified.

In either situation, air or lighter-than-air cycle Stirling engines, it is desirable to streamline them, simplifying their design and reducing their weight, while maintaining or improving their operating efficiencies.

While many of the prior designs of Stirling engines have proven acceptable in certain applications, there exists an ever present need to improve on such designs to provide a more efficient and less expensive engine.

SUMMARY OF THE INVENTION

It is a principal object of the present invention to provide for a Stirling engine, which is relatively simple and inexpensive yet efficient.

It is another object of the present invention to reduce dead volume space in a Stirling engine thereby improving its thermodynamic efficiency.

It is further object of the present invention to eliminate complicated piston seal designs and their attendant disadvantages, heretofore utilized.

Another object is to provide for a simplified control therefor, adding to its simplicity and reducing its cost.

The present invention provides for a Stirling engine design, particularly suitable for a two piston single acting 90° V-type, which positions the cooler and regenerator directly over the cold piston adjacent the compression space so as to minimize cold compression duct volume. Also, a piston and sealing arrangement which includes pressurizing the crankcase is provided which eliminates the need for piston seals, crossheads or piston rods. In addition, a simplified power control system is included.

The design provided is relatively simple, yet efficient and may utilize air or lighter-than-air working fluids in operation. Furthermore, due to the nature of the design, it is modular and can be readily applied in multiples to produce a larger engine.

BRIEF DESCRIPTION OF THE DRAWINGS

Thus, by the present invention, the aforenoted objects, advantages and others will be realized, the description of which should be taken in conjunction with the drawings, wherein.

DETAILED DESCRIPTION OF THE PREFERRED EMBODIMENT

Figure 1:
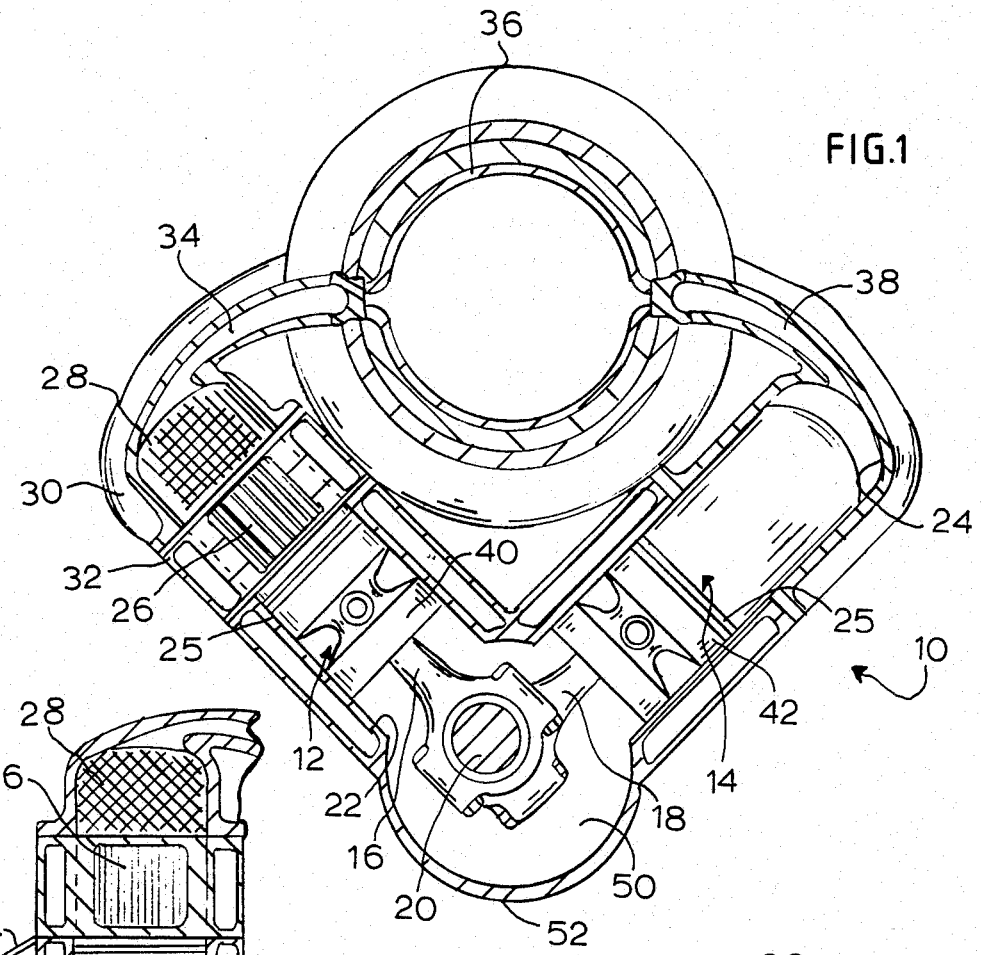
FIG. 1 is a schematic view of a single acting two piston V-type Stirling engine, incorporating the teachings of the present invention.

With more particular reference to the drawings, in FIG. 1 there is shown the basic layout for two piston Stirling engine or cycle 10. In this regard, a two piston arrangement is utilized rather than a piston-displacer type so as to allow for the maximum volume change during the cycle. The engine includes a flat head compression piston 12 and dome shaped expansion piston 14 which are driven by connecting rods 16 and 18 coupled to the same crankshaft 20. The piston axes are arranged to be separated by an angle of crank rotation equal to the desired phase separation between the two pistons. Typically, the ideal angle is about 90°, expansion side leading to provide manufacturing ease and improved balancing.

As shown, the compression piston 12 is positioned in a cylindrical compression space 22 with the expansion space defined by housing 24. Each of the pistons is provided with piston rings 25 which provide cycle-to-crankcase sealing. Immediately adjacent the compression space 22 there is provided a cooler 26 and regenerator 28 which may be constructed in accordance with standard procedures. In addition, while any cooler construction suitable for purpose may be utilized, a cooler constructed in accordance with my U.S. patent application Ser. No. 605,473 filed on Apr. 30, 1984, now abandoned, entitled, "Gas Cooler," commonly assigned herein, is particularly appropriate.

Regenerator 28 is positioned in housing 30 with the cooler 26 including perhaps its own housing 32.

A connecting duct 34 couples the regenerator to the heater tubes 36. The expansion space 24 is also coupled to the heating tubes 36 via connecting duct 38. Note that the shape of the heater tubes forms a tunnel appropriate for insertion into a fluestack however this is merely illustrative since any heating arrangement suitable for the purpose may be utilized.

The pistons are provided with low friction plastic pads such as PTFE on the piston skirts at 40 and 42 as currently used in oilless air compressors.

Since there is no use of piston rods, rod seals or crossheads, it is desirable to eliminate the use of oil as a lubricant which might leak into the Stirling cycle. In this regard, the connecting rods 16 and 18 are coupled to the crankshaft 20 by way of roller bearings 44 which are either greased and sealed or utilize dry lubricant (graphite cages). This eliminates the need for oil to lubricate these members.

However, since the loading on this engine will be relatively high, active cooling of the roller bearings is desired. This can be accomplished by passing a coolant through the crankshaft 20 (hollow) which serves as the inner race 46 (only one is shown) for the piston roller bearings and also serves as part of the cooling loop 48. Alternatively, air pumped by the motion of the pistons could be directed at the roller bearing and outer races. If necessary, a check-valving means could be incorporated to carry the air through an external cooler by creating a net flow loop.

Figure 2:
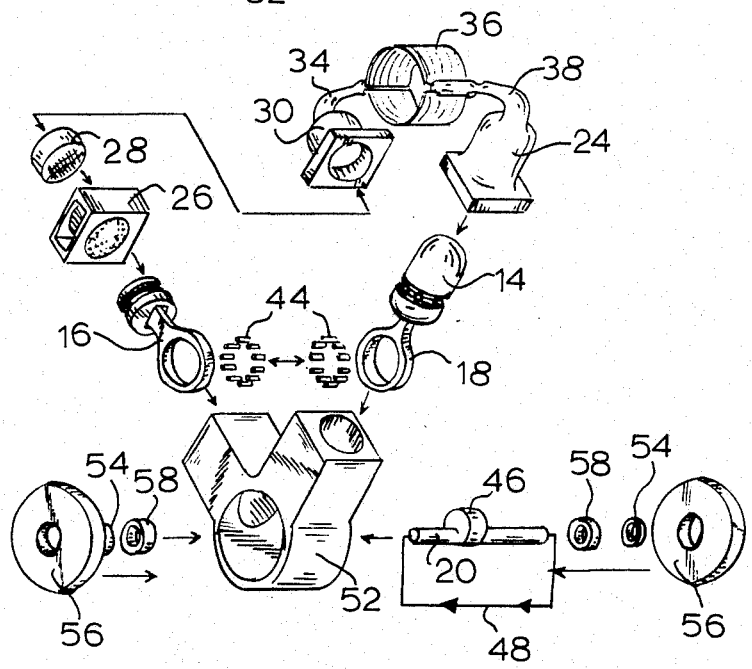
FIG. 2 is an exploded view of the major components of the Stirling cycle, incorporating the teachings of the present invention.

The crankcase area 50 of cylinder block 52 is pressurized to the mean cycle pressure which serves to relieve the bearings and rings of much of their loading. In this regard, and as shown in FIG. 2, pressure seals 54 are provided in addition to end caps 56, with the crankshaft 20 supported by main bearings 58 in the crankcase.

Figure 3:
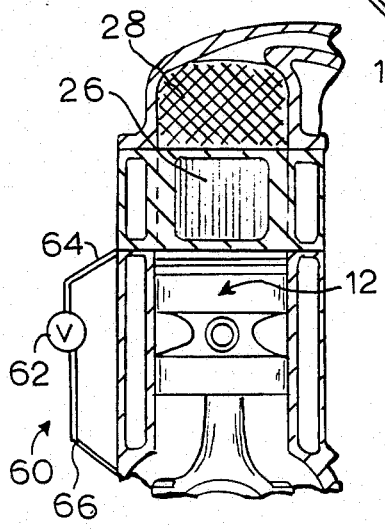
FIG. 3 is a schematic view of the compression control, incorporating the teachings of the present invention.

With reference now to FIG. 3, there is shown a control system 60. This control system 60, while less efficient than the complicated systems heretofore utilized (see e.g., U.S. Pat. No. 3,999,388, issued Dec. 28, 1976), performs satisfactorily and has the advantage of being inexpensive. A simple multi-orificed (for linear response) flow diversion valve 62 is provided which is coupled via conduit 64 to the cold space between the cooler 26 and compression piston 12 and conduit 66 to the crankcase 50. This valve 62 may merely comprise a multi-orifice plate occluded by a guillotin valve plate and provides a bypass around the compresson piston. For less than maximum power, the valve 62 is opened to the desired degree allowing some portion of the working gas flow to be diverted into the crankcase 50 (at mean pressure) and back out again instead of through the heat exchangers thus reducing the pressure wave of the cycle. Activation of the valve would require little effort and could be by a manual lever etc.

As is apparent, the construction of this design is very simple and of relative low cost while being reliable. This engine is modular and can be readily coupled with others sharing a common combustor and arranged on a common crankshaft axis. Note, that in a multiple cycle engine, the compression control system would simply be used in a ganged manner for all. Also, the coupling of similar cycles allows the assembly to be given a full dynamic balance.

Thus by the present invention, its objects and advantages, are realized and although a preferred embodiment has been disclosed and described in detail herein, its scope should not be limited thereby, rather its scope should be determined by that of the appended claims.

What is claimed is:

1. A Stirling cycle engine comprising: a compression piston reciprocal in a cold compression space and an expansion piston operated from a common crank shaft reciprocal in an expansion space out of phase with respect to each other; said pistons reciprocating along axes which are angularly disposed to one another, such that a V-configuration engine is formed; cooling means; regenerator means; said regenerator means being positioned immediately adjacent the cooling means; said cooling means being axially aligned immediately adjacent the cold compression piston so as to minimize cold duct volume; and heating means coupled with said regenerator and said expansion space completing the Stirling cycle.

2. The invention in accordance with claim 1, which includes control means comprising flow diversion valve in a conduit which allows the working gas to bypass the compression cylinder, with the regulation of the flow diversion valve determining the average amount of working gas in the cycle thus regulating the pressure wave of the cycle and accordingly the power output.

3. The invention is accordance with claim 1, wherein a plurality of said Stirling cycle engines are arranged together to form a common multi-cylinder Stirling cycle engine.

* * * * *